US005141601A

United States Patent [19]

Karlsson et al.

[11] Patent Number: 5,141,601

[45] Date of Patent: * Aug. 25, 1992

[54] PRESS ROLL WITH WEDGE CLAMP FOR THE PRESS-JACKET EDGES

[75] Inventors: Nils-Erik R. Karlsson; Leif S. Karlsson, both of Karlstad, Sweden

[73] Assignee: Valmet Paper Machinery, Inc., Helsi Ngfors, Finland

[ * ] Notice: The portion of the term of this patent subsequent to Mar. 24, 2009 has been disclaimed.

[21] Appl. No.: 638,796

[22] Filed: Jan. 8, 1991

[51] Int. Cl.[5] ..... D21F 3/02

[52] U.S. Cl. ..... 162/358.3; 29/117; 162/272; 162/361

[58] Field of Search ..... 162/358, 361, 205, 272; 100/118, 153; 29/116.2, 117

[56] References Cited

U.S. PATENT DOCUMENTS

| | | | |
|---|---|---|---|
| 4,044,669 | 8/1977 | Luther | 29/117 |
| 4,563,245 | 1/1986 | Wanke et al. | 162/358 |
| 4,584,059 | 4/1986 | Schiel et al. | 162/361 |
| 4,625,376 | 12/1986 | Schiel et al. | 29/119 |
| 4,707,222 | 11/1987 | Müllner et al. | 162/205 |
| 5,011,578 | 4/1991 | Lange | 162/358 |

FOREIGN PATENT DOCUMENTS

| | | |
|---|---|---|
| 3338487 | 10/1985 | Fed. Rep. of Germany . |
| 3607941 | 10/1988 | Fed. Rep. of Germany . |
| 3805350 | 8/1989 | Fed. Rep. of Germany . |
| 2272838 | 7/1975 | France . |

*Primary Examiner*—Karen M. Hastings

*Attorney, Agent, or Firm*—Bell, Seltzer, Park & Gibson

[57] ABSTRACT

The press roll cooperates with a counter roll to form a press with a long nip for paper or board machines. The press roll has two end walls; a flexible jacket secured to the end walls; and support members for the end walls. The end walls have bearings for permitting rotation of the jacket and the end walls in relation to the support members. A press shoe of the press roll cooperates with the counter roll to form a pressing zone. Attachment assemblies each have a circular clamping member, which includes a wedge body, and a circular groove disposed on the inside of the end wall to receive the edge portions of the jacket and the wedge body, the groove and wedge body being provided with cooperating wedge forming surfaces. Further, the clamping member includes bolts for pushing the wedge body into the groove and retaining it therein in order to clamp the edge portions of the jacket by means of wedge action, against the end wall. The groove is defined by an outer circumferential surface of the end wall and an outer ring secured to the end wall. The clamping member is located at the inner side of the jacket.

35 Claims, 3 Drawing Sheets

PRESS ROLL WITH WEDGE CLAMP FOR THE PRESS-JACKET EDGES

FIELD AND BACKGROUND OF THE INVENTION

The present invention relates to a press roll intended to cooperate with a counter roll to form a press with a long nip for paper or board machines.

Presses with a long nip for paper or board machines are known for instance through U.S. Pat. Nos. 4,563,245, 4,584,059, 4,625,376, 4,707,222, DE 3 607 941 and DE 3 805 350. The press roll of such presses comprises two end walls, a tubular, flexible, liquid-impervious jacket secured at its edge portions by means of an attachment means to peripheral portions of the end walls; stationary support members for supporting the end walls, said end walls having bearing means for permitting rotation of the jacket and the end walls in relation to the stationary support members about an axis of rotation; and a press shoe forming with the counter roll a pressing zone having said long nip, the jacket upon rotation being moved through the pressing zone in sliding contact with the press shoe. Within the pressing zone in said known presses, the jacket is forced inward by means of the counter roll to said sliding contact with the press shoe. The part of the jacket pressed against the press shoe will then lie in an axial line located radially inside a line extending between the peripheral end wall portions forming the attachment locations for the edge portions of the jacket, the radial distance between these lines being between 20 and 40 mm. High local axial strains occur in the jacket due to this pressing, when the jacket passes through the pressing zone. These local strains consequently cease immediately after the jacket has left the pressing zone. The strain thus occurring repeatedly in the jacket causes not only tensions at the attachment locations on the end walls and on the end wall bearings. The service life of the jacket becomes too short and both jacket and end wall bearings must be replaced regularly with consequential stoppages and loss of production. To secure the jacket to the end walls attachment means are used which include holes and/or recesses in the jacket itself for inserting bolts which by means of a clamping ring clamp the jacket against the end wall. Local strains occur at the holes and recesses which may cause the jacket to be damaged and the tension will be uneven around the circumference. Furthermore, the jacket may come loose at one or more points because the clamping ring and bolts provide insufficient clamping force to retain the jacket in the desired taut state. The use of holes and recesses in the edge portions of the jacket results in increased costs for manufacturing the jacket in accordance with carefully specified dimensions for each axial size of press roll.

DE Al 3 338 487 describes special connection means disposed at the edges of the jacket and the peripheral end wall portions so that the edge portions of the jacket are axially movable in relation to the end walls. The connection means include engagement means formed directly at the edge portions of the jacket, or separate axially movable engagement elements which can bend or roll and which connect the edge portions of the jacket to the end walls via a fixed securing member, or flexible sealing elements which connect the edge portion of the jacket to the end walls via an axially movable securing member, or a combination of the two first mentioned embodiments. The use of engagement means formed in the edge portions of the jacket results in increased costs for manufacturing the jacket in accordance with carefully specified dimensions for every axial size of press roll. The use of axially movable engagement elements, which can bend or jacket being pulled out of its engagement position after repeated axial movements of the edge portions to and fro. Furthermore, all embodiments of the connection means are relatively complicated to manufacture and fit.

SUMMARY OF THE INVENTION

The object of the present invention is to provide a press roll with improved attachment means which secure the jacket to the end walls with sufficient force, said force also being distributed uniformly around the circumference of each edge portion of the end wall, and said securing being intact and effected without holes or the like having to be made in the flexible jacket. The jacket can consequently be manufactured and mounted in a considerably simpler manner than known jackets.

The present invention relates to a press roll intended to cooperate with a counter roll to form a press with a long nip for paper or board machines, said press roll comprising two end walls, a tubular, flexible, liquid-impervious jacket secured at its edge portions by means of an attachment means to peripheral portions of the end walls; stationary support members for supporting the end walls, said end walls having bearing means for permitting rotation of the jacket and the end walls in relation to the stationary support members about an axis of rotation; and a press shoe forming with the counter roll a pressing zone with said long nip, said jacket upon rotation being moved through the pressing zone in sliding contact with the press shoe, said attachment means for securing an edge portion of the jacket to the end wall comprising a circular clamping member including a wedge body, and a circular groove disposed on the inside of said end wall to receive the edge portion of said jacket and wedge body, said groove and wedge body being provided with cooperating wedge-forming surfaces, said clamping member including means for forcing said wedge body into the groove and retaining it therein in order to clamp said edge portion of the jacket by means of wedge action, against said end wall, said groove being defined by an outer circumferential surface of the end wall and an outer ring which is secured to the end wall, and said clamping member being located at the inner side of the jacket.

The invention is described in more detail hereinafter with reference to the accompanying drawings.

DESCRIPTION OF PREFERRED EMBODIMENTS

Figure 1:
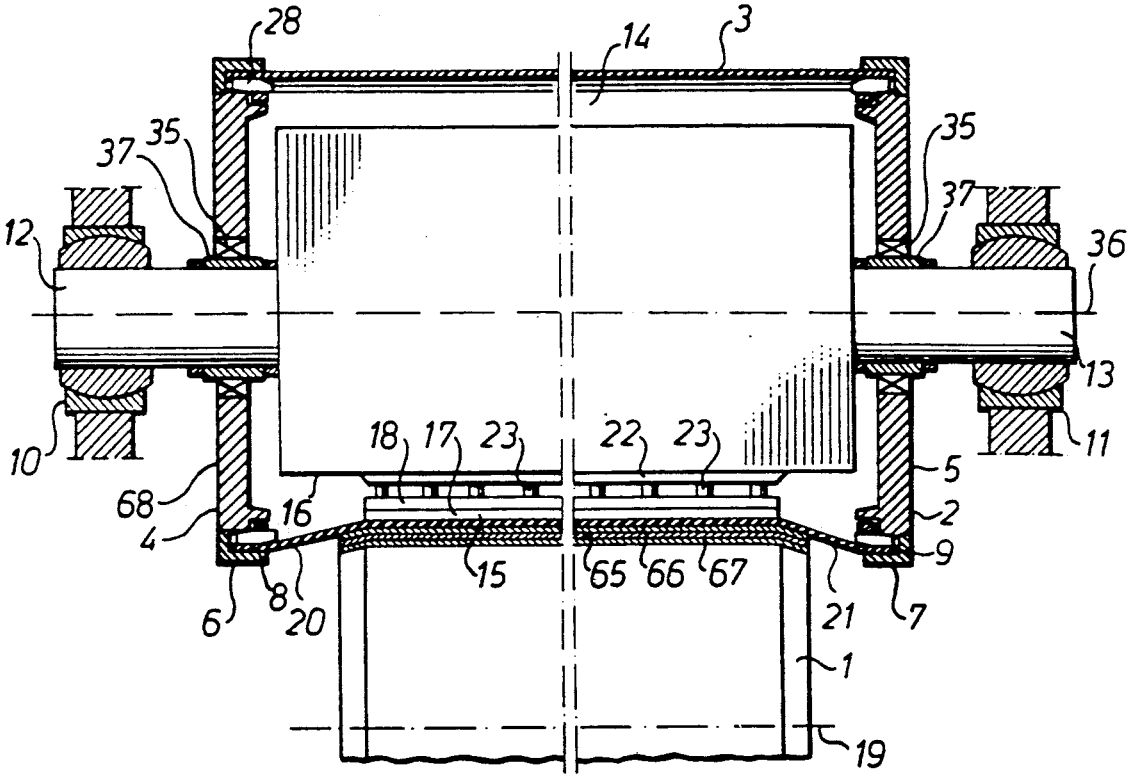
FIG. 1 is a partially schematic view, primarily in vertical section, of a press roll and adjacent compartment of a wet press having attachment means according to a first embodiment of the invention to secure a jacket to the press roll end walls.

Referring to FIG. 1, this shows schematically parts of a wet press disposed in the wet section of a paper machine or a board machine in order to press water out of and consolidate a formed wet fibrous web 65.

The wet press comprises a rotatable counter roll 1 and a press roll 2, which has a tubular reinforced jacket 3 impervious to liquid, and two opposite circular end walls 4, 5, the edge portions 8 and 9 of the jacket being connected in an air and liquid tight manner to the peripheral portions 6 and 7, respectively, of the end walls 4, 5 as will be described below. The jacket is flexible and dimensionally stable. The press roll is mounted in two stand parts 10, 11 by means of support members in the form of two stationary support pins 12, 13 of circular cross section, said support pins extending in an air-tight and liquid-tight manner through central openings in the end walls 4, 5. The end walls 4, 5, jacket 3 and support pins 12, 13 thus define an air-tight and liquid-tight chamber 14 which can be placed under sufficient pressure, e.g. 0.1 bar overpressure, to displace the end walls 4, 5 apart from each other in order to keep the jacket 3 sufficiently stretched. The end walls 4, 5 are consequently axially displaceable in relation to the support pins 12, 13. Alternatively, spring means (not shown) may be disposed in the press roll to press against the end walls or one of them in order to stretch the jacket in the axial direction. Pneumatic or hydraulic cylinders may also be utilized for this purpose, or any suitable combination of the three arrangements mentioned.

The press roll 2 also includes a press shoe 15 that is disposed opposite the counter roll 1 and which, together with it, forms a pressing zone having a long nip within a predetermined sector of the counter roll where the jacket 3 is thus pressed down against the press shoe and wraps the predetermined sector of the counter roll 1. The press shoe 15 is supported by an inner stand 16, preferably in the form of a beam secured to axially inner portions of the support pins 12, 13. Support means of suitable form, such as axial laths or strips (not shown) may be disposed on the inside of the jacket to provide support for the jacket when it is being mounted. Such support means may be attached to the inner stand 16 via suitable bracings (not shown).

The fibrous web to be dewatered is enclosed between two felts 66, 67, each disposed to run in a loop over a plurality of rolls (not shown) and through said pressing zone. During operation, the continuous wet fibrous web 65 runs through the pressing zone together with the felts 66, 67, which absorb the liquid pressed out of the fibrous web. If desired, the felt 67 adjacent the counter roll 1 may be omitted so that a single-felt press is obtained.

Any suitable press shoe may be used. The shoe 15 shown consists of a sliding part 17 and a frame part 18, the sliding part 17 having a slide surface along which the jacket 3 moves in sliding contact. The shoe 15 located opposite the counter roll 1 extends transversely across the jacket 3, parallel with the axis of rotation 19 of the counter roll 1 and it is the same length or slightly shorter than the length of the counter roll 1. This in turn is shorter than the press roll 2 so that inclined, indented sections 20, 21 are formed in those sections of the jacket 3 located axially outside of the counter roll, within the area for the pressing zone. In the preferred embodiment shown the press shoe 15 is connected to the stand 16 via a jack unit 22 having several jacks 23 by means of which the pressure of the press shoe 15 on the jacket 3 and the fibrous web can be controlled. A channel system (not shown) is also disposed in the press shoe 15 for the supply of lubricant to the sliding surface of the sliding part 17, thus producing and maintaining a friction-reducing film between the jacket 3 and press shoe 15. The press shoe 15 can be provided with hydrostatic pressure pockets (not shown) filled with pressure liquid acting on the inner side of the jacket 3 to compress the fibrous web in a controlled manner.

Circular bearing means 35 associated with end walls 4, 5 permit rotation of the jacket 3 and a section 68 of each end wall located radially outside the bearing means 35 about an axis of rotation 36 which need not necessarily coincide with the central axis of the support pins 12, 13. In the embodiment shown in FIG. 1, each bearing means 35 consists of rolling bearings, such as ball or roller bearings. Alternatively sliding bearings with flat or spherical sliding surfaces may be used. Further, end walls 4, 5 have cylindrical sliding bearings 37 arranged to allow axial displacement of the end wall 4, 5 in relation to the support pins 12, 13. Alternatively, only one of the end walls may be provided with such a sliding bearing 37 to effect axial displacement of the end wall 4 or 5.

The edge portions 8, 9 of the jacket 3 are rigidly connected by attachment means to the peripheral portions 6, 7 of the end walls to give a sufficiently strong and tight joint. The peripheral end wall portions 6, 7 are substantially rigid and are made of a suitable metal material. The same reference numerals are utilized in the following to indicate parts and elements which are similar or substantially similar in the different embodiments. According to the invention each attachment means includes a circular groove 24 disposed on the inside of each peripheral end wall portion 6, 7 and having two opposite side walls 25, 26 forming a small angle to each other so that the width of the groove 24, i.e. its radial dimension, decreases in the direction towards the bottom 27 of the groove. Said angle is typically about 5°. One of the end walls, viz. end wall 26, is arranged to receive the jacket 3 and preferably it extends axially (i.e., generally parallel to axis 36). The attachment means comprises a circular clamping member 32 which includes a wedge body 28 the shape of which corresponds to the shape of the groove 24, so that the wedge body and the groove have cooperating wedge-forming surfaces 25, 33 and 26, 34, that respectively clamp the edge portions 8, 9 of the jacket by wedge action. The opposite wedge forming surfaces 33, 34 of the wedge body 28 thus define a small angle with each other corresponding to said angle defined by the side walls 25, 26 of the groove 24. The clamping member 32 is provided with a plurality of axial tapped holes 30 that are aligned with axial holes 31 in the end wall 27. Bolts 29 inserted into holes 30, 31 from the outer side of the end wall are in threaded engagement with the holes 30 of the clamping member. By means of the bolts 29 the wedge body 28 is forced into the groove 24 so that the edge portion 8, 9 of the jacket is clamped by increasing wedge force between the wedge body 28 and the side wall 26 of the groove. It is understood that the wedge body 28 and the groove 24 are dimensioned with respect to each other so that the wedge body does not contact the bottom 27 of the groove.

Figure 4:
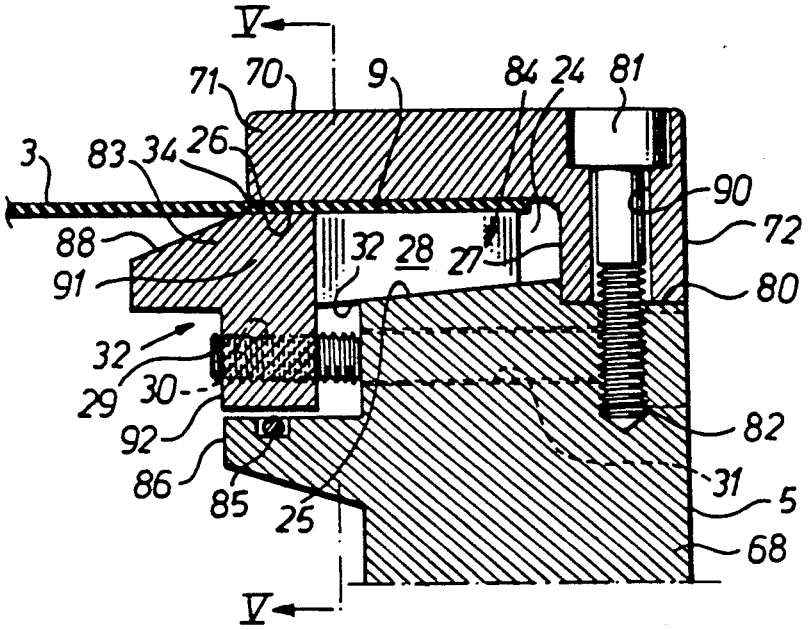
FIG. 4 is a view similar to FIG. 3 of an attachment means according to a second embodiment.
Figure 5:
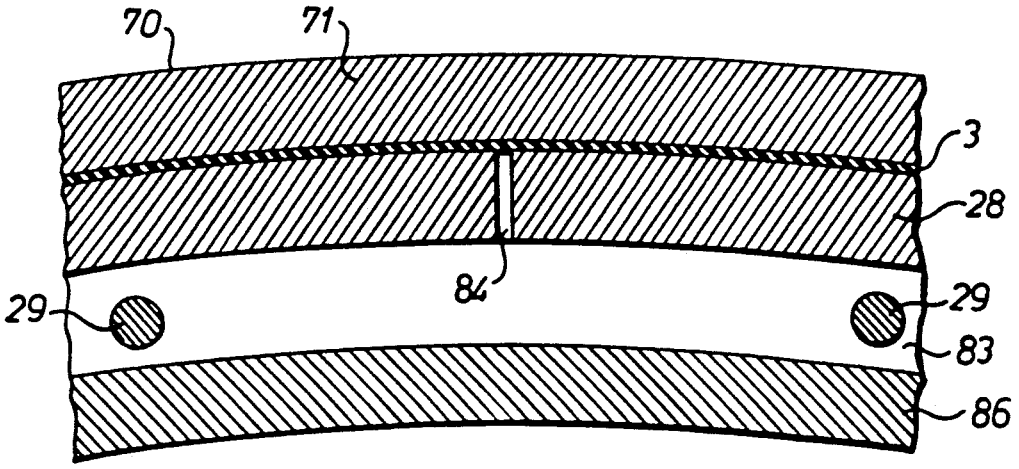
FIG. 5 is a sectional view taken substantially along the line V—V in FIG. 4.

In the embodiments of the attachment means illustrated in the drawings the groove 24 is located between and bordered by the outer circumferential surface of the end wall and a separate outer ring 70 which surrounds the end wall 4, 5. The outer ring 70 is of substantially L-shaped cross-section and has an axially extending shank 71 and a radially inwardly extending shank 72. The radial shank 72 is received in a corresponding recess 80 on the outer circumferential surface of the end wall. The outer ring 70 is screwed to the end wall by means of a plurality of radial bolts 81 extending through radial holes 90 in the shank 72 and screwed into tapped radial holes 82 in the end wall. The groove 24 is bordered by the axial shank 71 and the end wall 4, 5. The clamping members 32 are located on the inner side of the jacket 3. The radially outer side wall 26 of the groove 24 extends axially in order to receive the edge portions of the jacket, and the radially inner side wall 25 is bevelled. In addition to the wedge body 28 the clamping members 32 also include a tension body 83 located axially inwardly of the wedge body 28 and including a radially outer portion 91 and a radially inner portion 92. The inner portion 92 extends radially inward from the wedge body 28, and in the axial direction it is located at a distance from the end wall in order to permit the wedge body 28 to be pushed into the groove 24. In the embodiment according to FIGS. 1 to 3 the wedge body 28 and tension body 83, seen in a cross section, are formed as an integral piece, whereas in the embodiment according to FIGS. 4 and 5 said bodies 28, 83 are formed as separate pieces. The surface of the tension body 83 facing the jacket is formed with a sloping conical guide surface 88 intended to facilitate insertion of the edge portion of the jacket 3 into the groove 24 when the jacket is being mounted. The radially inner portion 92 of tension body 83 has axial tapped holes 30 which are aligned with axial through-holes 31 in the end wall for insertion of bolts 29 from the outer side of the end wall. The bolts are received by and threaded into the holes 30 of the tension body 83. By means of the bolts 29 the radially inner portion 92 of tension body 83 is pulled in the direction to the end wall 4, 5 so that the radially outer portion 91 of tension body 83 pushes the wedge portion 28 into the groove 24.

Figure 2:
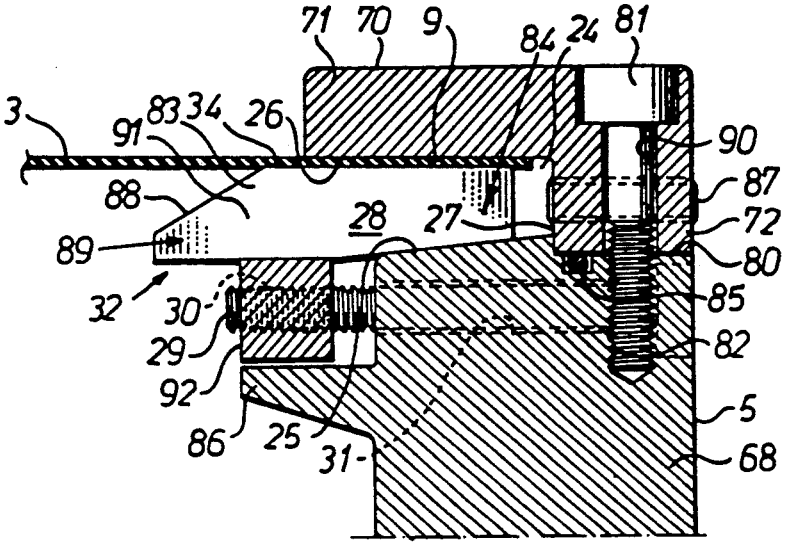
FIG. 2 is an enlarged fragmentary sectional view of one of the attachment means according to FIG. 1, in which the groove of the attachment means is surrounded by an outer ring of the end wall.
Figure 3:
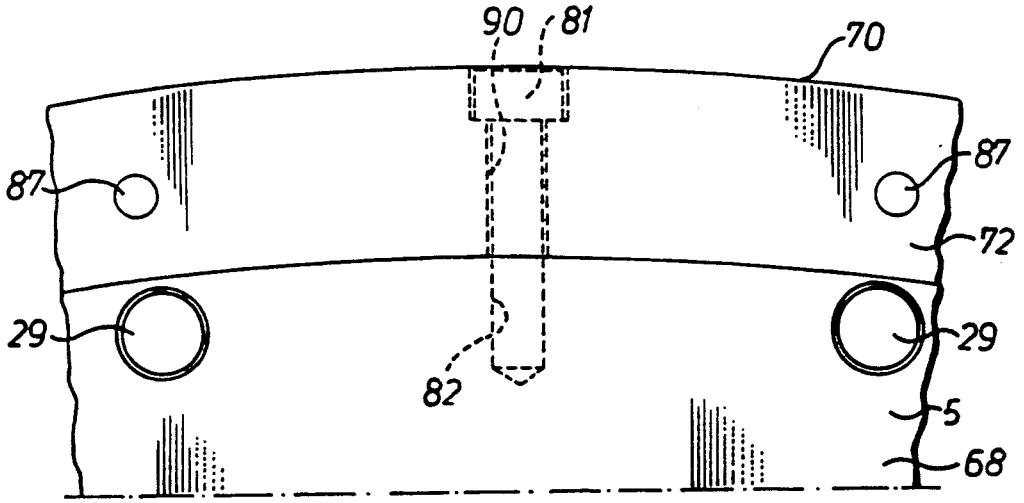
FIG. 3 is an end view of a section of the end wall with the attachment means according to FIG. 2.

In order to ensure a uniform distribution of the wedge forces circumferentially the clamping members 32 are provided with a plurality of slots, e.g. 12 slots, extending radially and axially. In the embodiment according to FIGS. 1 to 3 the wedge body 28 is provided with through-slots 84, and the radially outer portion 91 of the tension body 83 is provided with through-slots 89, which are aligned with the slots 84, whereas in the embodiment according to FIGS. 7 and 8 only the wedge body 28 is provided with through-slots 84. It is preferred in the first case to dispose a seal 85 between the outer ring 70 and the end wall, whereas in the second case a similar seal(s) 85 may be provided at the same position and/or between the tension body 83 of the clamping member and a part of the end wall. Said part may consist of a support ring 86 protruding from the inner side of the end wall. When the clamping member 32 is to be loosened in connection with dismantling of the jacket it may be desirable to use a plurality of press screws 87 which are screwed into axial tapped holes in the radial shank 72 of the outer ring, said press screws being aligned with the groove 24 as illustrated in FIGS. 2 and 3. The press screws 87 are screwed into engagement with the wedge body 28 and urge the wedge body until the wedge engagement is released. Before the press screws 87 are screwed in the axial bolts 29 are first loosened and then the radial bolts 81 so that the clamping member 32 will be free to move when the press screws 87 are screwed in.

The outer ring 70 of the embodiments shown may consist of a plurality of identical circular arc-segment. The clamping member 32 according to FIG. 2 may be formed as a circumferentially unitary ring or may be divided into identical or similar segments with or without said slots. The wedge body 28 according to FIG. 4 may consist of a circumferentially unitary ring or a ring divided into identical segments with or without said slots, whereas the tension body 83 consists of a circumferentially unitary ring or a ring divided into identical or similar segments.

An advantage of locating the clamping members 32 radially inside the jacket, as shown, is that it is not necessary to remove them when the jacket is to be replaced. A further advantage is that the clamping members 32 have a cylindrical outer surface 26 so that they can be attached to the end walls and easily be machined to appropriate roundness and desired outer diameter. Another advantage is that the cross-section of the outer ring 70 is decreased markedly resulting in a markedly decreased weight of each segment so that the handling of the segments is facilitated when the jacket is to be replaced, in particular in connection with rolls having large diameter.

Before the bolts 29 are fully tightened it is advisable to place the chamber 14 under a low over-pressure by blowing in air. The jacket 3 will then endeavour to assume a uniform shape circumferentially and should any unevenness exist differences will appear in the axial strains at the edge portions 8, 9 of the jacket. Since axial movement of the edge portions is now permitted those circumferentially sections of the edge portions where the strains are greatest will be pulled out until uniformity has been achieved. Thereafter the bolts 29 are finally tightened to achieve the desired strong wedge joint.

That which is claimed is:

1. A press roll for a wet press having a counter roll to form a press with a long nip for paper or board machines, said press roll comprising two end walls each having an inner surface and an outer surface, a tubular, flexible, liquid-impervious jacket secured at its edge portions by means of an attachment means to peripheral portions of the end walls; stationary support members for supporting the end walls, said end walls including bearing means for permitting rotation of the jacket and the end walls in relation to the stationary support members about an axis of rotation; and a press shoe forming with the counter roll a pressing zone having said long nip, said jacket upon rotation being moved through the pressing zone in sliding contact with the press shoe, said attachment means for securing an edge portion of the jacket to the end wall comprising a circular clamping member including a wedge body, and a circular groove opening from the inner surface of said end wall to receive the edge portion of said jacket and wedge body, said groove and wedge body being provided with cooperating wedge-forming surfaces, said clamping member including means for forcing said wedge body into the groove and retaining it therein in order to clamp said edge portion of the jacket within said groove by means of wedge action against said end wall, said groove being defined by an outer circumferential surface of the end wall and an outer ring which is directly attached to the end wall, and said clamping member being located radially inwardly of the jacket.

2. A press roll as recited in claim 1 wherein said outer ring is secured to the end wall by means of a plurality of bolts.

3. A press roll as recited in claim 2 wherein said outer ring has a substantially L-shaped cross-section and includes an axially extending shank surrounding said groove and a radially extending shank provided with holes for said bolts for attaching the outer ring onto the end wall.

4. A press roll as recited in claim 3 wherein said holes are radially disposed in said radial shank and are aligned with radial tapped holes in said end wall for screwing said bolts therein.

5. A press roll as recited in claim 1 wherein said outer ring is formed by a plurality of circular arc-segments.

6. A press roll as recited in claim 1 wherein said clamping member is provided with axial tapped holes aligned with axial through-holes in said end wall, and said means for forcing said wedge body into said groove and retaining it therein include a corresponding number of bolts screwed into said clamping member.

7. A press roll as recited in claim 6 wherein said clamping member includes a tension body located axially inwardly of said wedge body and including a radially outer portion and a radially inner portion extending radially inward from said wedge body, said radially inner portion being located at an axial distance from said end wall to permit the wedge body to be pushed into the groove, and said holes of said clamping member for said bolts are disposed in said radially inner portion of the tension body.

8. A press roll as recited in claim 7 wherein said clamping member includes a guide surface for guiding the jacket into said groove when the jacket is being mounted.

9. A press roll as recited in claim 7 wherein said wedge body and said tension body form an integral ring.

10. A press roll as recited in claim 9 wherein said clamping member has a plurality of slots extending axially and radially through said wedge body.

11. A press roll as recited in claim 7 wherein said clamping member has a plurality of slots extending axially and radially through said wedge body and a plurality of slots extending axially and radially through said radially outer portion of the tension body.

12. A press roll as recited in claim 11, wherein said slots in the wedge body are aligned with said slots in the radially outer portion of the tension body.

13. A press roll as recited in claim 3 wherein a plurality of press screws are axially disposed in said radial shank of the outer ring and aligned with said groove, said screws when screwed into the groove and pressing against said wedge body being adapted to release said wedge action.

14. A press roll as recited in claim 1, wherein said clamping member is provided with axial tapped holes aligned with axial through-holes in said outer ring thereof, and said means for forcing said wedge body into said groove and retaining it therein includes a corresponding number of bolts for screwing into said clamping member.

15. A press roll for a wet press having a counter roll to form a press with a long nip for paper or board machines, said press roll comprising two end walls each having an inner surface and an outer surface, a tubular, flexible, liquid-impervious jacket secured at its edge portions by means of an attachment means to peripheral portions of the end walls; stationary support members for supporting the end walls, said end walls including bearing means for permitting rotation of the jacket and the end walls in relation to the stationary support members about an axis of rotation; and a press shoe forming with the counter roll a pressing zone having said long nip, said jacket upon rotation being moved through the pressing zone in sliding contact with the press shoe, said attachment means for securing an edge portion of the jacket to the end wall comprising a circular clamping member including a wedge body, and a circular groove opening from the inner surface of said end wall to receive the edge portion of said jacket and wedge body, said groove converging inwardly toward its bottom, and the side wall of the groove contacted by the jacket being substantially parallel with the axis of rotation of the jacket, said groove and wedge body being provided with cooperating wedge-forming surfaces, said clamping member including means for forcing said wedge body into the groove and retaining it therein in order to clamp said edge portion of the jacket within said groove by means of wedge action against said end wall, said groove being defined by an outer circumferential surface of the end wall and an outer ring which is directly attached to the end wall, and said clamping member being located radially inwardly of the jacket.

16. A press roll as recited in claim 15 wherein said outer ring is secured to the end wall by means of a plurality of bolts.

17. A press roll as recited in claim 16 wherein said outer ring has a substantially L-shaped cross-section and includes an axially extending shank surrounding said groove and a radially extending shank provided with holes for said bolts for attaching the outer ring onto the end wall.

18. A press roll as recited in claim 17 wherein said holes are radially disposed in said radial shank and are aligned with radial tapped holes in said end wall for screwing said bolts therein.

19. A press roll as recited in claim 15 wherein said outer ring is formed by a plurality of circular arc-segments.

20. A press roll as recited in claim 15 wherein said clamping member includes a guide surface for guiding the jacket into said groove when the jacket is being mounted.

21. A press roll as recited in claim 15 wherein said clamping member includes a tension body axially outwardly of said wedge body and said wedge body and said tension body form an integral ring.

22. A press roll as recited in claim 15 wherein said clamping member has a plurality of slots extending axially and radially through said wedge body.

23. A press roll as recited in claim 15 wherein said clamping member includes a tension body axially outwardly of said wedge body and said clamping member has a plurality of slots extending axially and radially through said wedge body and a plurality of slots extending axially and radially through said radially outer portion of the tension body.

24. A press roll as recited in claim 23 wherein said slots in the wedge body are aligned with said slots in the radially outer portion of the tension body.

25. A press roll as recited in claim 15 wherein a plurality of press screws are axially disposed in said outer ring and aligned with said groove, said screws when screwed into the groove and pressing against said wedge body being adapted to release said wedge action.

26. A press roll as recited in claim 15 wherein said clamping member is provided with axial tapped holes aligned with axial through-holes in said outer ring thereof, and said means for forcing said wedge body into said groove and retaining it therein includes a corresponding number of bolts for screwing into said clamping member.

27. A press roll for a wet press with a counter roll to form a press with a long nip for paper or board machines, said press roll comprising two end walls each having an inner surface and an outer surface, a tubular, flexible, liquid-impervious jacket secured at its edge portions by means of an attachment means to peripheral portions of the end walls; stationary support members for supporting the end walls, said end walls including bearing means for permitting rotation of the jacket and the end walls in relation to the stationary support members about an axis of rotation; and a press shoe forming with the counter roll a pressing zone having said long nip, said jacket upon rotation being moved through the pressing zone in sliding contact with the press shoe, said attachment means for securing an edge portion of the jacket to the end wall comprising a circular clamping member including a wedge body, and a circular groove of said end wall to receive the edge portion of said jacket and wedge body, said groove converging inwardly toward its bottom, and the side wall of the groove contacted by the jacket being substantially parallel with the axis of rotation of the jacket, said groove and wedge body being provided with cooperating wedge-forming surfaces, said clamping member including means for forcing said wedge body into the groove and retaining it therein in order to clamp said edge portion of the jacket within said groove by means of wedge action against said end wall, said groove being defined by an outer circumferential surface of the end wall and an outer ring which is directly attached to the end wall, said clamping member being located radially inwardly of the jacket and being provided with axial through-holes in said end wall, said means for forcing said wedge body into said groove and retaining it therein including bolts screwed into said clamping member, said clamping member including a tension body located axially inwardly of said wedge body and including a radially outer portion and a radially inner portion extending radially inward from said wedge body, said radially inner portion being located at an axial distance from said end wall to permit the wedge body to be pushed into the groove, said holes of said clamping member for said bolts being disposed in said radially inner portion of the tension body, the wedge body and the tension body being formed as separate rings.

28. A press roll as recited in claim 27 wherein said outer ring is attached to the end wall by means of a plurality of bolts.

29. A press roll as recited in claim 28 wherein said outer ring has a substantially L-shaped cross-section and includes an axially extending shank surrounding said groove and a radially extending shank provided with holes for said bolts for attaching the outer ring onto the end wall.

30. A press roll as recited in claim 29 wherein said holes are radially disposed in said radial shank and are aligned with radial tapped holes in said end wall for screwing said bolts therein.

31. A press roll as recited in claim 27 wherein said clamping member has a plurality of slots extending axially and radially through said wedge body.

32. A press roll as recited in claim 27 wherein said clamping member has a plurality of slots extending axially and radially through said wedge body and a plurality of slots extending axially and radially through said radially outer portion of the tension body.

33. A press roll as recited in claim 32 wherein said slots in the wedge body are aligned with said slots in the radially outer portion of the tension body.

34. A press roll as recited in claim 27 wherein the outer ring has a radial shank, and a plurality of press screws are axially disposed in said radial shank of the outer ring and aligned with said groove, said press screws when screwed into the groove and pressing against said wedge body being adapted to release said wedge action.

35. A press roll as recited in claim 27 wherein said means for forcing said wedge body into said groove and retaining it therein includes bolts for screwing into said clamping member.

* * * * *